US009562446B2

(12) United States Patent
Kawakami et al.

(10) Patent No.: US 9,562,446 B2
(45) Date of Patent: Feb. 7, 2017

(54) ENGINE

(71) Applicant: MITSUBISHI JIDOSHA KOGYO KABUSHIKI KAISHA, Tokyo (JP)

(72) Inventors: Nobuhiro Kawakami, Okazaki (JP); Hayato Sugimura, Okazaki (JP); Toshihiko Oka, Anjo (JP); Kazuki Yagi, Okazaki (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 115 days.

(21) Appl. No.: 14/562,806

(22) Filed: Dec. 8, 2014

(65) Prior Publication Data

US 2015/0159523 A1 Jun. 11, 2015

(30) Foreign Application Priority Data

Dec. 9, 2013 (JP) ..... 2013-254103

(51) Int. Cl.
*F01M 9/10* (2006.01)
*F01L 1/344* (2006.01)
(Continued)

(52) U.S. Cl.
CPC ..... *F01L 1/3442* (2013.01); *F01L 1/34* (2013.01); *F01M 9/10* (2013.01); *F01L 2001/0476* (2013.01); *F01L 2001/0535* (2013.01); *F01L 2001/0537* (2013.01); *F01L 2001/34423* (2013.01); *F01L 2001/34426* (2013.01); *F01L 2001/34433* (2013.01)

(58) Field of Classification Search
CPC ..... F01L 1/3442; F01L 2001/0476; F01L 2001/0537; F01L 2001/34423; F01L 2001/34433
USPC ..... 123/90.33, 90.34, 90.15, 90.17, 90.38
See application file for complete search history.

(56) References Cited

U.S. PATENT DOCUMENTS 6,026,772 A * 2/2000 Shirabe ..... F01L 1/3442 123/90.17
6,263,844 B1 7/2001 Ozeki et al.
2008/0092843 A1 4/2008 Yamada

FOREIGN PATENT DOCUMENTS

EP 0 945 598 A2 9/1999
EP 1 316 682 A2 6/2003
(Continued)

OTHER PUBLICATIONS

Extended European Search Report dated Apr. 1, 2015 issued in corresponding European Application No. EP 14 19 6832.1.

*Primary Examiner* — Ching Chang
(74) *Attorney, Agent, or Firm* — Birch, Stewart, Kolasch & Birch, LLP

(57) ABSTRACT

An engine includes: an oil control valve built in a cylinder head, and configured to control a pressure of oil to be supplied to a variable valve mechanism via a camshaft; and a cam cap fixed to an upper face of the cylinder head, and configured to rotatably support the camshaft between the cam cap and the cylinder head, as a flow passage for the oil to be force-fed from an oil pump to the oil control valve, the cam cap including: a lateral passage formed inside the cam cap, and extended in a direction along the upper face of the cylinder head; and a downward passage extended downward from the lateral passage so as to serve as a downstream side flow passage of the lateral passage, and configured to guide the oil toward the oil control valve.

22 Claims, 3 Drawing Sheets

(51) Int. Cl.

| | |
|---|---|
| ***F01L 1/34*** | (2006.01) |
| *F01L 1/047* | (2006.01) |
| *F01L 1/053* | (2006.01) |

(56) References Cited

FOREIGN PATENT DOCUMENTS

| | | | | |
|---|---|---|---|---|
| JP | 2004-92567 | A | 3/2004 | |
| JP | 2013-163973 | A | 8/2013 | |
| WO | WO 2009/013588 | A2 * | 1/2009 | ..... F01L 1/3442 |

* cited by examiner

ENGINE

CROSS-REFERENCE TO RELATED APPLICATION(S)

This application is based upon and claims the benefit of priority from prior Japanese patent application No. 2013-254103, filed on Dec. 9, 2013, the entire contents of which are incorporated herein by reference.

BACKGROUND

The present invention relates to an engine, and more particularly, to the structure of an oil-supplying route from an oil pump to an oil control valve in an engine with a variable valve mechanism.

As an engine to be mounted on a vehicle, an engine equipped with a variable valve mechanism for controlling the operation of intake and exhaust valves has been widely used. The variable valve mechanism is a mechanism for changing the maximum valve lift amount and/or the valve timing of the intake valves and/or the exhaust valves. The maximum valve lift amount can be changed by increasing or decreasing the reciprocating stroke of the intake and exhaust valves. Furthermore, the valve timing can be changed by moving the phase of the rotation angle of the camshaft in the advancing direction or in the delaying direction with respect to the rotation angle of the crankshaft. The combustion state and combustion efficiency inside the cylinder can be controlled properly and the exhaust performance and fuel consumption of the engine can be improved by controlling the operation of the intake and exhaust valves using this kind of variable valve mechanism.

As the driving system of the variable valve mechanism, an electric type and a hydraulic type are available. In the electric variable valve mechanism, the variable valve mechanism is driven by an electric motor to control the operation of the intake and exhaust valves. On the other hand, this kind of electric variable valve mechanism has problems in the durability and reliability of the electric motor that operates continuously under a high temperature environment. Furthermore, the structures of the cams and camshaft become complicated, thereby having a problem of high cost. Hence, the hydraulic variable valve mechanism is generally used more than the electric variable valve mechanism under the current circumstances.

In many of hydraulic variable valve mechanisms, after the pressure of oil pressurized by an oil pump is adjusted by an oil control valve (hydraulic control valve, OCV), the oil is introduced into the variable valve mechanism via a camshaft. The pressure of the oil introduced into the variable valve mechanism as described above is controlled by the oil control valve, whereby the operation amount of the variable valve mechanism can be continuously changed and satisfactory controllability can be obtained (for example, refer to JP-A-2013-163973).

In the above-mentioned existing hydraulic variable valve mechanism, for example, a mechanical pump operating interlocked with the crankshaft is used as an oil pump. Furthermore, the oil control valve is built in the cylinder head and disposed in the vicinity of the camshaft. In other words, the entire oil flow passage from the oil pump to the oil control valve is built in the cylinder block and the cylinder head. Hence, the temperature of the oil flowing into the oil control valve is liable to rise, and the controllability of the oil control valve becomes low in some cases.

Moreover, in the case of an engine having two camshafts for driving the respective intake and exhaust valves independently (in other words, an engine equipped with a DOHC intake-exhaust valve mechanism), the engine is provided with an oil passage for supplying oil to the camshaft on the intake side and an oil passage for supplying oil to the camshaft on the exhaust side. Hence, in the case that the related-art oil passages described in JP-A-2013-163973 are used, numerous oil passages are required to be formed inside the cylinder head, whereby the structure of the cylinder head becomes complicated.

SUMMARY

The present invention may provide an engine capable of improving the controllability of an oil control valve by using a simple configuration.

The engine may comprise: an oil control valve which is built in a cylinder head, and which is configured to control a pressure of oil to be supplied to a variable valve mechanism via a camshaft; and a cam cap which is fixed to an upper face of the cylinder head, and which is configured to rotatably support the camshaft between the cam cap and the cylinder head, as a flow passage for the oil to be force-fed from an oil pump to the oil control valve, the cam cap including: a lateral passage which is formed inside the cam cap, and which is extended in a direction along the upper face of the cylinder head; and a downward passage which is extended downward from the lateral passage so as to serve as a downstream side flow passage of the lateral passage, and which is configured to guide the oil toward the oil control valve.

The cam cap may include a groove passage which is formed in a concave groove shape at a bottom face of the cam cap, and which is configured to guide the oil to be supplied via the oil control valve toward a supporting face for the camshaft.

The variable valve mechanism may be configured to control a phase angle of the camshaft, and the groove passage may include: an advance angle groove passage serving as an oil flow passage for moving the phase angle in an advancing direction, and a delay angle groove passage serving as an oil flow passage for moving the phase angle in a delaying direction.

A portion of the upper face of the cylinder head which is opposed to the groove passage of the cam cap may be formed into a flat shape.

The camshaft may be an exhaust camshaft, the cam cap may be configured to rotatably support the exhaust camshaft and an intake camshaft, and the oil control valve may be an exhaust oil control valve to be used for a variable valve mechanism for an exhaust valve.

The engine may further comprise: an intake oil control valve which is disposed on an intake port side of the engine, and which is built in the cylinder head, the intake oil control valve which is configured to control a pressure of the oil to be supplied to a variable valve mechanism for an intake valve via the intake camshaft. A flow passage for the oil to be force-fed from the oil pump to the intake oil control valve may be formed in the cylinder head.

The cam cap may include a groove passage for the variable valve mechanism for the intake valve, which is formed in a concave groove shape at a bottom face of the cam cap, and which is configured to guide the oil to be supplied via the intake oil control valve toward a supporting face for the intake camshaft.

The downward passage may be disposed outside a range between the intake camshaft for driving an intake valve and the exhaust camshaft for driving the exhaust valve in an extension direction of the lateral passage.

The cam cap may include a lubrication passage which is formed in a concave groove shape at a bottom face of the cam cap, and which is disposed so as to be connected between the intake camshaft for driving an intake valve and the exhaust camshaft for driving the exhaust valve.

The lateral passage may be inclined so as to become lower, as being extended toward a downstream side of the oil, and the downward passage may be extended downward from a lowest end portion of the lateral passage.

The downward passage may be linearly connected between one end portion of the lateral passage and a bottom face of the cam cap.

The oil may be to be supplied from the other end portion of the lateral passage.

As the flow passage for the oil to be force-fed from the oil pump to the oil control valve, the cam cap may include an upward passage which is extended upward toward the other end portion of the lateral passage so as to serve as an upstream side flow passage of the lateral passage.

According to the invention, the engine may comprise: an intake oil control valve which is built in a cylinder head, and which is configured to control a pressure of oil to be supplied to a variable valve mechanism for an intake valve via an intake camshaft; an exhaust oil control valve which is built in the cylinder head, and which is configured to control a pressure of oil to be supplied to a variable valve mechanism for an exhaust valve via an exhaust camshaft; a cam cap which is fixed to an upper face of the cylinder head, and which is configured to rotatably support the intake camshaft and the exhaust camshaft between the cam cap and the cylinder head; an oil-supplying route for the intake oil control valve, through which the oil is force-fed from an oil pump built in the cylinder head to the intake oil control valve; and an oil-supplying route for the exhaust oil control valve, through which the oil is force-fed from the oil pump to the exhaust oil control valve via a passage formed inside the cam cap.

The exhaust oil control valve may be disposed outside the exhaust camshaft, and the passage may be formed so as to be extended outside a range between the intake camshaft and the exhaust camshaft.

The intake oil control valve may be disposed outside the intake camshaft, the oil-supplying route for the exhaust oil control valve may be branched from the oil-supplying route for the intake oil control valve and passes through the passage.

The passage may include: a lateral passage which is extended in a direction along the upper face of the cylinder head; and a downward passage which is extended downward from the lateral passage so as to serve as a downstream side flow passage of the lateral passage, and which is configured to guide the oil toward the exhaust oil control valve.

The cam cap may include a groove passage which is formed in a concave groove shape at a bottom face of the cam cap, and which is configured to guide the oil to be supplied via the intake oil control valve and the exhaust oil control valve toward a supporting face for the intake camshaft and a supporting face for the exhaust camshaft.

The variable valve mechanism for the intake valve and the variable valve mechanism for the exhaust valve may be configured to control a phase angle of the intake camshaft and a phase angle of the exhaust camshaft, respectively, and for the variable valve mechanisms, the groove passage may include: an advance angle groove passage serving as an oil flow passage for moving the phase angle in an advancing direction, and a delay angle groove passage serving as an oil flow passage for moving the phase angle in a delaying direction.

A portion of the upper face of the cylinder head which is opposed to the groove passage of the cam cap may be formed into a flat shape.

DETAILED DESCRIPTION OF EXEMPLARY EMBODIMENTS

Figure 1:
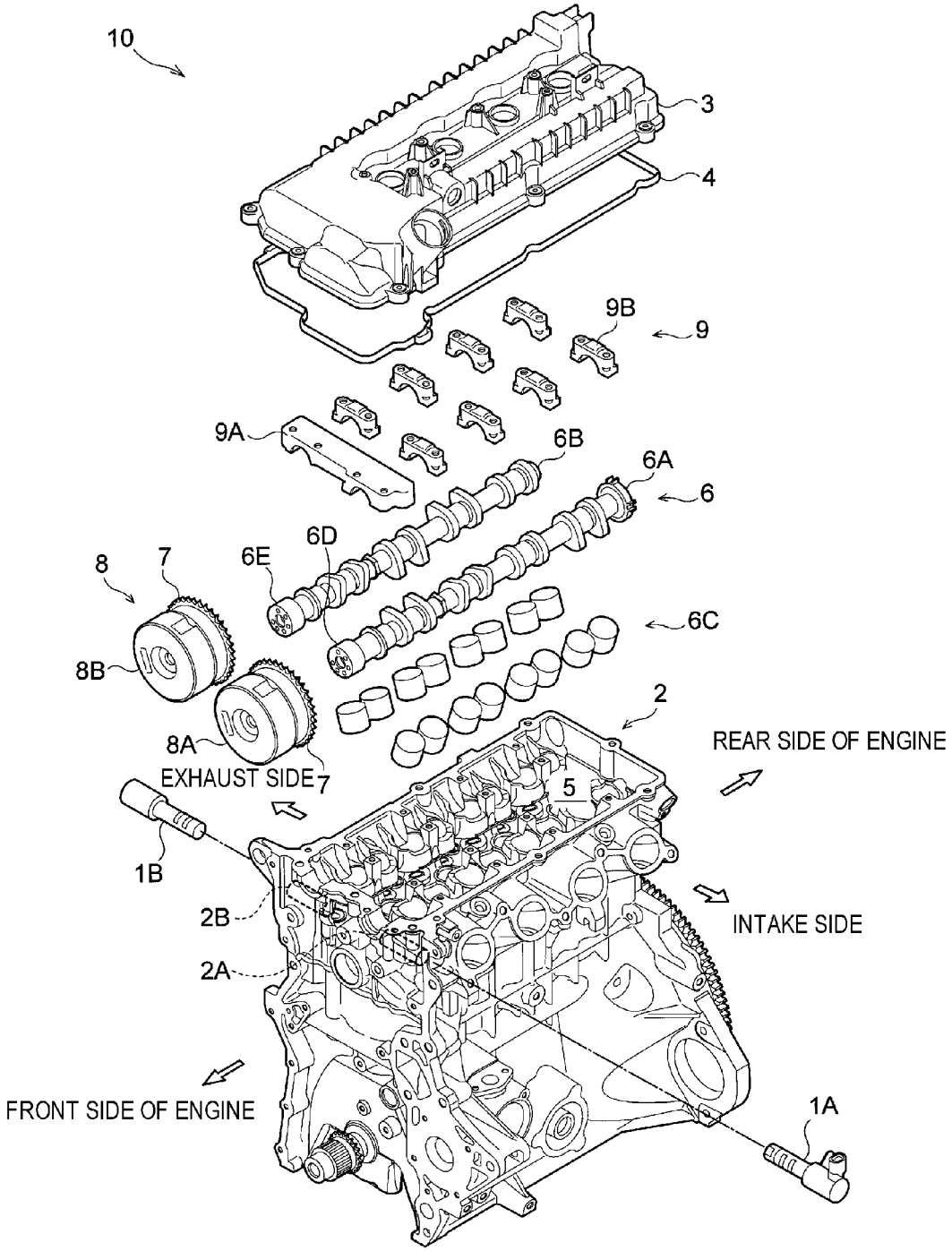
FIG. 1 is an exploded perspective view showing an engine according to an embodiment.

An engine applied to a vehicle will be described referring to the drawings. However, the embodiment described below is merely an example and is not intended to exclude the application of various modifications and technologies not specified in the embodiment described below. The respective configurations according to this embodiment can be embodied while being modified variously within the range not departing from the gist thereof, and the configurations can be selected as necessary or combined appropriately.

1. Engine Configuration

A cam cap 9 according to this embodiment is mounted on a cylinder head 2 of an engine 10 shown exploded in FIG. 1. This engine 10 is, for example, an in-line multi-cylinder, double overhead camshaft (DOHC) gasoline engine. Auxiliary devices and power transmission pulleys (crank pulleys, timing pulleys, sprockets, etc.) of the engine 10 are provided on the front side (in the lower left direction in FIG. 1) of the engine 10. On the other hand, a drive plate and a flywheel are provided on the rear side (in the upper right direction in FIG. 1) of the engine 10 and connected to various apparatuses (for example, a transmission, rotating electric devices, etc.) on the downstream side of the power train of the vehicle.

A cylinder block incorporating hollow cylindrical cylinders arranged in a row is provided under the cylinder head 2. On the other hand, a head cover 3 for covering the entire upper face of the cylinder head 2 is mounted on the cylinder head 2. The head cover 3 is fastened and fixed to the upper face of the cylinder head 2 via a gasket 4. The space surrounded by the upper face of the cylinder head 2 and the head cover 3 serves as a valve chamber 5 incorporating a valve driving mechanism for driving the intake and exhaust valves of the engine 10.

In the following descriptions, the side of the cylinder head 2 to which the cylinder block is fixed is referred to as the lower side, and the opposite side thereof is referred to as the upper side. In addition, of the side faces of the cylinder head 2, the side on which the upstream end opening of the intake port is positioned is referred to as the intake side, and the opposite side thereof is referred to as the exhaust side. However, since the engine 10 is installed in a posture inclined (not horizontal) with respect to the vehicle in some cases, the up-down direction herein do not necessarily correspond to the vertical up-down direction. It is assumed that the engine 10 according to this embodiment is fixed to the vehicle in a posture wherein the entire engine 10 is turned and inclined around the crankshaft so that the intake port inside the cylinder head 2 is positioned higher than the exhaust port (so that the intake side is directed upward and the exhaust side is directed downward).

Camshafts 6 extending along the row-arrangement direction of the cylinders are disposed inside the valve chamber 5. FIG. 1 shows an intake camshaft 6A for driving the intake valves and an exhaust camshaft 6B for driving the exhaust valves. A plurality of cams having chevron shapes corresponding to the opening/closing timing and the valve lift amounts of the intake and exhaust valves are mounted on the respective camshafts 6. These cams push down tappets 6C provided at the upper ends of the intake and exhaust valves, thereby driving the intake and exhaust valves in the up-down direction.

Furthermore, a cam sprocket 7 around which a timing chain is wound and a phase actuator 8 (variable valve mechanism) are provided at the end portion of the camshaft 6 on the front side of the engine 10. The phase actuator 8 is a hydraulic apparatus for changing the phase of the rotation angle of the camshaft 6 with respect to the rotation angle of the crankshaft, and the phase actuator 8 is, for example, integrated with the cam sprocket 7. A mechanism for moving the phase angle of the camshaft 6 in the advancing direction or in the delaying direction with respect to the cam sprocket 7 is built inside the phase actuator 8, whereby the phase of the camshaft 6 is controlled as desired on the basis of control signals from an electronic control apparatus, not shown.

Inside the phase actuator 8, for example, the camshaft 6 is supported so as to be rotatable with respect to the rotation center of the cam sprocket 7, and two hydraulic chambers are provided between the camshaft 6 and the cam sprocket 7. One of the hydraulic chambers is disposed at the position where the phase angle of the camshaft 6 is moved in the advancing direction, and the other hydraulic chamber is disposed at the position where the phase angle of the camshaft 6 is moved in the delaying direction. With this structure, the phase angle of the camshaft 6 with respect to the cam sprocket 7 corresponds to the pressure difference between the hydraulic chambers. Specific structure and control configuration of the phase actuator 8 are not limited to those described above, but known variable valve timing mechanisms can be applied. In the following descriptions, the phase actuators 8 provided respectively for the intake camshaft 6A and the exhaust camshaft 6B are referred to as an intake phase actuator 8A and an exhaust phase actuator 8B, respectively, as necessary.

These camshafts 6 are rotatably supported between the sliding bearing portions of the cylinder head 2 and the sliding bearing portions of cam caps 9. As shown in FIG. 1, of the plurality of the cam caps 9, the front cam cap 9A disposed closest to the front side of the engine 10 is formed so as to have a size capable of supporting both the intake camshaft 6A and the exhaust camshaft 6B. On the other hand, the other cam caps 9B are formed so as to have a small size capable of supporting either one of the intake camshaft 6A and the exhaust camshaft 6B. Hence, the front cam cap 9A according to this embodiment has a bearing function corresponding to two of the other cam caps 9B.

As shown in FIG. 1, the front cam cap 9A has a size ranging from the intake camshaft 6A in the vicinity of the intake phase actuator 8A to the exhaust camshaft 6B in the vicinity of the exhaust phase actuator 8B. The shape of the front cam cap 9A is an oblong shape having a width enough to cover both the intake camshaft 6A and the exhaust camshaft 6B from above when the engine 10 is viewed from the front side. The front cam cap 9A supports the intake journal portion 6D of the intake camshaft 6A disposed adjacent to the intake phase actuator 8A and also supports the exhaust journal portion 6E of the exhaust camshaft 6B disposed adjacent to the exhaust phase actuator 8B. On the other hand, the cam caps 9B other than the front cam cap 9A are formed into a semi-circular concave shape so as to be able to support only the journal portions of the camshaft 6 disposed adjacent to the center of the cylinder when the engine 10 is viewed from above.

An oil control valve (OCV) 1 for controlling the pressure of the oil (hydraulic oil) to be supplied to the phase actuator 8 is built in the cylinder head 2. The oil control valve 1 is disposed under the phase actuator 8 in a state in which the camshaft 6 is mounted on the cylinder head 2. In addition, the oil control valve 1 is provided for each of the intake phase actuator 8A and the exhaust phase actuator 8B. As shown in FIG. 1, a mounting hole 2A into which an intake oil control valve 1A is inserted is formed under the intake phase actuator 8A inside the cylinder head 2, and a mounting hole 2B into which an exhaust oil control valve 1B is inserted is formed under the exhaust phase actuator 8B. The intake oil control valve 1A and the exhaust oil control valve 1B are inserted into these mounting holes 2A and 2B and fixed thereto.

2. Oil Passages

Figure 2:
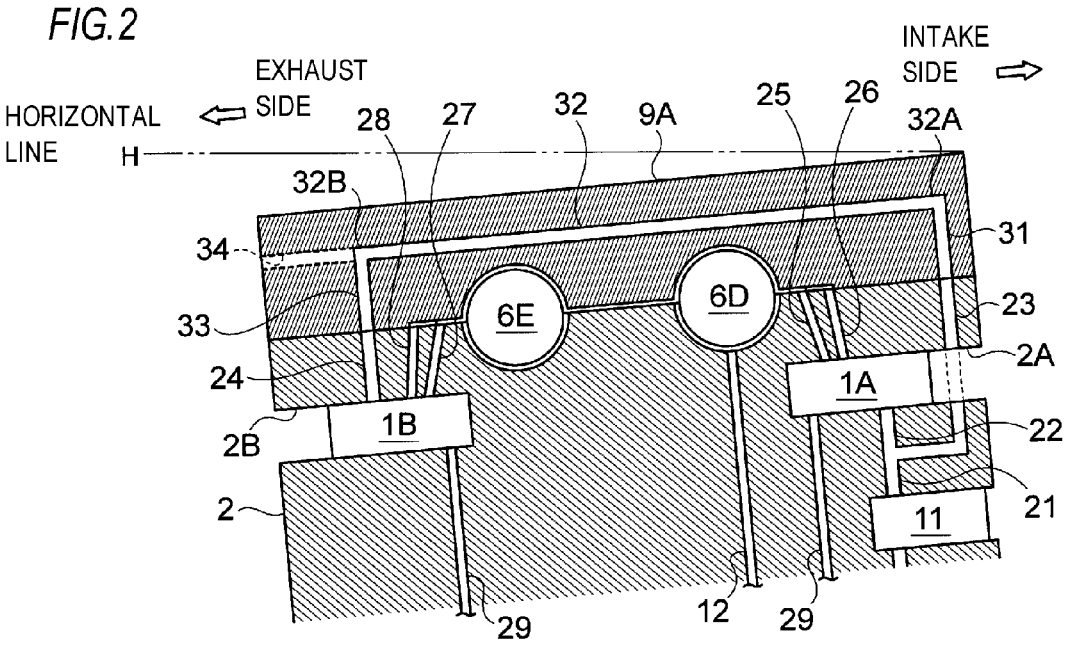
FIG. 2 is a schematic vertical cross-sectional view showing the internal structure of a cam cap.

FIG. 2 is a schematic cross-sectional view illustrating the passages for the oil to be supplied to the phase actuator 8. The oil passages relating to the driving of the phase actuator 8 and the oil passages for lubricating the sliding bearing portions of the camshaft 6 will herein be described. The oil to be supplied to the phase actuator 8 is force-fed from an oil pump, not shown, and filtered at an oil filter 11, and then supplied to each of the intake oil control valve 1A and the exhaust oil control valve 1B. Furthermore, in the intake oil control valve 1A and the exhaust oil control valve 1B, the oil pressure is adjusted depending on the operation state of the engine 10, and the pressure in the hydraulic chamber built in the phase actuator 8 is controlled. On the other hand, lubricating oil is directly supplied from an oil pump, not shown, to the intake journal portion 6D of the intake camshaft 6A via a bearing lubrication passage 12.

The intake oil control valve 1A is positioned on the intake side where the temperature of the cylinder head 2 is relatively low. The entire oil-supplying route (the flow passage from the oil filter 11 to the intake oil control valve 1A) for supplying the oil to the intake oil control valve 1A is built in the cylinder head 2 as shown in FIG. 2. On the other hand, the exhaust oil control valve 1B is positioned on the exhaust side where the temperature of the cylinder head 2 is relatively high. Hence, if the entire oil-supplying route for supplying the oil to the exhaust oil control valve 1B is built in the cylinder head 2, the temperature of the oil flowing into the exhaust oil control valve 1B becomes high, and the controllability of the exhaust oil control valve 1B may become low in some cases. For this reason, in this embodiment, the oil-supplying route for supplying the oil to the exhaust oil control valve 1B is formed outside the cylinder head 2 so that the oil is passed through the interior of the front cam cap 9A. In addition, the oil-supplying route for supplying the lubricating oil to the exhaust journal portion 6E of the exhaust camshaft 6B is also formed so as to pass through the outside of the cylinder head 2.

As shown in FIG. 2, a first passage 21 disposed so as to extend upward from the oil filter 11 along the side face on the intake side of the cylinder head 2 is formed inside the cylinder head 2. In addition, this first passage 21 is branched into two passages under the intake oil control valve 1A, whereby a second passage 22 and a third passage 23 are formed. The second passage 22 is a linear passage extending in the direction in which the first passage 21 is extended upward, and the tip end thereof is connected to the intake oil control valve 1A. On the other hand, the third passage 23 extends to the intake side of the engine 10 in the direction perpendicular to the second passage 22 and then extends upward in parallel with the second passage 22, and the tip end thereof reaches the upper face of the cylinder head 2. The upper end of the third passage 23 is positioned inside the joint face between the cylinder head 2 and the front cam cap 9A. The portion indicated by thin broken lines in FIG. 2 shows that the third passage 23 passes at a position different from the position of the mounting hole 2A of the intake oil control valve 1A in the depth direction of the figure.

Between the intake oil control valve 1A and the intake journal portion 6D, an intake advance angle passage 25 for moving the phase angle of the intake camshaft 6A in the advancing direction and an intake delay angle passage 26 for moving the phase angle in the delaying direction are provided. The upper ends of these passages 25 and 26 are open at the upper face of the cylinder head 2, and the passages 25 and 26 respectively communicate with the oil passages formed inside the intake camshaft 6A via the front cam cap 9A. Excess oil at the intake oil control valve 1A is returned to the side of the oil pump via an oil dropping passage 29.

Inside the front cam cap 9A, an upward passage 31, a lateral passage 32 and a downward passage 33 are formed as flow passages for guiding the oil to be transferred from the side of the upward passage 31 to the side of the exhaust oil control valve 1B. The upward passage 31 is a linear passage extending in the direction in which the third passage 23 is extended upward, and the tip end thereof is connected to one end 32A of the lateral passage 32. In addition, the lateral passage 32 is a linear passage extended in the direction along the upper face of the cylinder head 2 and is disposed above the intake journal portion 6D and the exhaust journal portion 6E so as to make a detour around the journal portions.

As shown in FIG. 2, the position of the one end 32A of the lateral passage 32 is set at the highest position in a state in which the engine 10 is installed in the vehicle. Hence, the lateral passage 32 is disposed so as to make a downward slope from the one end 32A toward the side of the other end 32B thereof. Inside the lateral passage 32, the side from which oil is supplied is the side of the one end 32A. Hence, the oil flows down smoothly toward the other end 32B on the downstream side even if the oil is not pressurized.

The downward passage 33 is a linear passage extended downward from the other end 32B of the lateral passage 32 so as to serve as the flow passage on the downstream side of the lateral passage 32. The upper end of the downward passage 33 communicates with the lateral passage 32, and the lower end of the downward passage 33 reaches the bottom face of the front cam cap 9A. In other words, the downward passage 33 is connected between the lateral passage 32 and the bottom face of the front cam cap 9A, and the lower end thereof is positioned inside the joint face of the cylinder head 2 and the front cam cap 9A. Furthermore, the downward passage 33 is disposed outside the range between the intake camshaft 6A and the exhaust camshaft 6B. FIG. 2 shows an example in which the downward passage 33 is disposed on the left side of the exhaust camshaft 6B (on the exhaust side of the exhaust camshaft 6B, that is, on the outside of the exhaust camshaft 6B) and in the up-down direction along the side face on the exhaust side of the front cam cap 9A.

The portion (indicated by a thick broken line in FIG. 2) drilled in the direction extending from the lateral passage 32 from the connection point of the lateral passage 32 and the downward passage 33 is an embedded passage 34. This embedded passage 34 is a passage for product processing required to form the lateral passage 32 and is closed after the processing of the lateral passage 32 is completed. Hence, the upper end of the downward passage 33 is extended downward from the lowest position inside the lateral passage 32.

As shown in FIG. 2, inside the cylinder head 2, a fourth passage 24 is provided as a flow passage for guiding the oil flowing through the downward passage 33 to the exhaust oil control valve 1B. The fourth passage 24 is a linear passage extending in the downward extension direction of the downward passage 33, and the tip end thereof is connected to the exhaust oil control valve 1B. As in the case that the downward passage 33 is disposed on the outside of the exhaust camshaft 6B, the fourth passage 24 is disposed along the side face on the exhaust side of the cylinder head 2.

Between the exhaust oil control valve 1B and the exhaust journal portion 6E, an exhaust advance angle passage 27 for moving the phase angle of the exhaust camshaft 6B in the advancing direction and an exhaust delay angle passage 2B for moving the phase angle in the delaying direction are provided. The upper ends of these passages 27 and 28 are open at the upper face of the cylinder head 2, and the passages 27 and 28 respectively communicate with the oil passages formed inside the exhaust camshaft 6B via the front cam cap 9A. Excess oil at the exhaust oil control valve 1B is also returned to the side of the oil pump via the oil dropping passage 29, as in the case of the excess oil at the intake oil control valve 1A.

Figure 3:
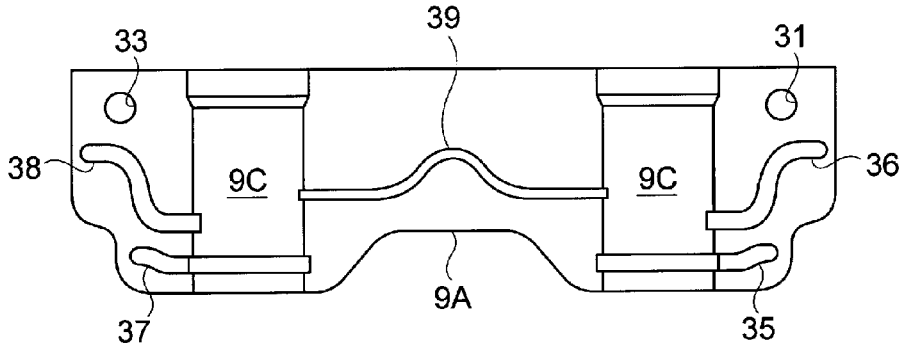
FIG. 3 is a schematic bottom view showing the shape of the bottom face of the cam cap.

FIG. 3 is a schematic bottom view illustrating the shape of the bottom face of the front cam cap 9A. At the bottom face of the front cam cap 9A, an intake advance angle groove passage 35, an intake delay angle groove passage 36, an exhaust advance angle groove passage 37 and an exhaust delay angle groove passage 38 are formed as groove passages for respectively connecting the intake advance angle passage 25, the intake delay angle passage 26, the exhaust advance angle passage 27 and the exhaust delay angle passage 28 described above to flow the passages 41 and 42, described later, provided inside the camshaft 6. These groove passages 35 to 38 are provided in a concave groove shape at the bottom face of the front cam cap 9A and function so as to guide the oil toward the support face of the camshaft 6.

The intake advance angle groove passage 35 serves as an oil flow passage for moving the phase angle of the intake camshaft 6A in the advancing direction, and the intake delay angle groove passage 36 serves as an oil flow passage for moving the phase angle of the intake camshaft 6A in the delaying direction. Similarly, the exhaust advance angle passage 37 serves as an oil flow passage for moving the phase angle of the exhaust camshaft 6B in the advancing direction, and the exhaust delay angle groove passage 38 serves as an oil flow passage for moving the phase angle of the exhaust camshaft 6B in the delaying direction. These groove passages 35 to 38 are almost symmetric bilaterally as shown in FIG. 3.

At the bottom face of the front cam cap 9A, a lubrication passage 39 is disposed to make connection between the two bearing cylinder faces 9C for supporting the intake camshaft 6A and the exhaust camshaft 6B. This lubrication passage 39 is provided in a concave groove shape at the bottom face of the front cam cap 9A and has a function of passing the excess oil at the one bearing cylinder face 9C to the other bearing cylinder face 9C. For example, the lubricating oil supplied to the intake journal portion 6D of the intake camshaft 6A via the bearing lubrication passage 12 is also supplied to the exhaust journal portion 6E of the exhaust camshaft 6B via the lubrication passage 39.

Figure 4:
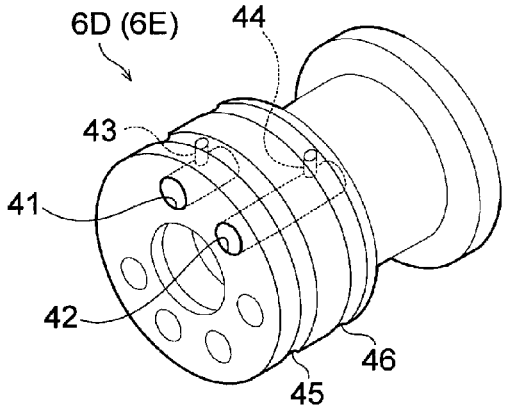
FIG. 4 is a schematic perspective view showing the shapes of oil passages in the journal portion of a camshaft.

Examples of the shapes of the oil passages in the intake journal portion 6D and the exhaust journal portion 6E are shown in FIG. 4. It is herein assumed that the intake journal portion 6D and the exhaust journal portion 6E have the same structure.

Inside the camshaft 6, the advance angle flow passage 41 and the delay angle flow passage 42 being independent of each other are formed. These flow passages 41 and 42 are respectively connected to the two hydraulic chambers provided in the phase actuator 8. Furthermore, radial flow passages 43 and 44 are formed from the respective flow passages 41 and 42 toward the radial outside of the camshaft 6, and the annular flow passage grooves 45 and 46 passing through the outer circumferential ends of the radial flow passages 43 and 44 are provided by engraving the entire circumferences of the journal portions 6D and 6E. These flow passage grooves 45 and 46 are formed so as to communicate with the above-mentioned groove passages 35 to 38. Hence, the oil entering from the groove passages 35 to 38 is guided to the flow passages 41 and 42 formed in the camshaft 6 and introduced into the phase actuators 8A and 8B, respectively.

3. Operational Advantage (1) Inside the above-mentioned front cam cap 9A, as shown in FIG. 2, the lateral passage 32 extended in the direction along the upper face of the cylinder head 2 and the downward passage 33 for guiding the oil toward the exhaust oil control valve 1B, serving as the flow passage on the downstream side of the lateral passage 32, are provided. Hence, the oil can be supplied to the exhaust oil control valve 1B without providing a complicated oil-supplying route inside the cylinder head 2.

Furthermore, since a fire contact face serving as the ceiling face of the combustion chamber (cylinder) is disposed at the lower face of the cylinder head 2, the temperature of the cylinder head 2 becomes higher at the lower side closer to the cylinder block. On the other hand, since the above-mentioned front cam cap 9A is disposed at a position away from the fire contact face, its temperature hardly becomes relatively high even during the operation of the engine 10. Since the oil flow passages are provided inside the front cam cap 9A in which a relatively low temperature state is liable to be maintained, the temperature of the oil to be introduced into the exhaust oil control valve 1B can be lowered. Hence, the controllability of the oil pressure in the exhaust oil control valve 1B can be improved. In addition, the control accuracy of the oil pressure can also be improved, and the operation stability, responsiveness and controllability of the phase actuator 8 can be improved. Moreover, since the temperature of the oil introduced into the exhaust oil control valve 1B becomes low, the heat deterioration of the oil can be suppressed.

What's more, since the oil fed to the lateral passage 32 inside the front cam cap 9A passes through the downward passage 33 and drops to the exhaust oil control valve 1B, the oil pressure inside the lateral passage 32 is not required to be set to an excessively high pressure. In other words, after the oil has been fed to at least the one end 32A of the lateral passage 32, the oil flows into the exhaust oil control valve 1B by its own weight even if the oil pressure is low.

Consequently, the force-feeding capacity of the oil pump can be made small. In addition, since the force feed pressure of the oil lowers, oil leakage from the oil-supplying route can be suppressed. Furthermore, since the oil pressure inside the lateral passage 32 can be made low, the control of the fastening pressure between the front cam cap 9A and the cylinder head 2 is made easy, the sliding performance and durability of the sliding bearing portions for supporting the camshaft 6 can be improved, whereby the quality of the product can be improved.

(2) At the bottom face of the above-mentioned front cam cap 9A, as shown in FIG. 3, the groove passages 35 to 38 are formed. These groove passages 35 to 38 are formed into a concave groove shape to connect the advance angle passages 25 and 27 and the delay angle passages 26 and 28 formed in the cylinder head 2 to the flow passages 41 and 42 inside the camshaft 6, respectively. On the other hand, the groove passages 35 to 38 are disposed inside the joint face of the cylinder head 2 and the front cam cap 9A, and the upper face of the cylinder head 2 opposed to the groove passages 35 to 38 are formed into a flat face shape.

At the joint face between the cylinder head 2 and the front cam cap 9A, the groove passages 35 to 38 serving as the passages for the oil to be supplied from the intake oil control valve 1A and the exhaust oil control valve 1B are provided in a concave shape on the side of the front cam cap 9A as described above. Hence, the flow passages for pressure-adjusted oil can be formed without processing the upper face of the cylinder head 2, whereby the oil can be supplied to the camshaft 6 using a simple structure.

(3) At the bottom face of the above-mentioned front cam cap 9A, the advance angle passages 35 and 37 corresponding to the advance angle passages 25 and 27 as well as the delay angle passages 36 and 38 corresponding to the delay angle passages 26 and 28 are provided. Hence, the two kinds of passages for driving the phase actuator 8 can be secured at the bottom face of the front cam cap 9A using a simple structure. In addition, since these groove passages 35 to 38 are formed so as to be almost symmetric bilaterally as shown in FIG. 3, the weight balance in a state in which the front cam cap 9A is fixed to the upper face of the cylinder head 2 can be made appropriate, whereby the state of supporting the camshaft 6 can be made stable.

(4) In the above-mentioned front cam cap 9A, as shown in FIG. 2, the lateral passage 32 is extended from the right side of the intake camshaft 6A to the left side of the exhaust camshaft 6B. In other words, the downward passage 33 is disposed on the outside (on the exhaust side of the exhaust camshaft 6B) of the range between the intake camshaft 6A and the exhaust camshaft 6B. Since the downward passage 33 is provided at a position close to the end face of the exhaust side of the cylinder head 2 as described above, the performance for cooling the oil flowing through the downward passage 33 can be improved. Furthermore, the oil can be dropped at a position closer to the exhaust oil control valve 1B, whereby the length of the oil flow route can be made short. Moreover, since the exhaust oil control valve 1B can be provided at a position close to the outer surface of the cylinder head 2, the depth of the mounting hole 2B of the exhaust oil control valve 1B can be made small and the structure of the cylinder head 2 can be made simple.

(5) In the above-mentioned front cam cap 9A, as shown in FIG. 3, the lubrication passage 39 is formed inside the range between the intake camshaft 6A and the exhaust camshaft 6B. On the other hand, the upward passage 31, the downward passage 33 and the groove passages 35 to 38 are provided outside the range between the intake camshaft 6A and the exhaust camshaft 6B.

In other words, when attention is paid to the joint face of the cylinder head 2 and the front cam cap 9A, the flow range of the lubricating oil is set in a region (inside) where temperature becomes relatively high, and the flow range of the oil relating to the driving of the phase actuator 8 is set in a region (outside) where temperature is liable to become relatively low. Since the flow passage range at the joint face between the cylinder head 2 and the front cam cap 9A is set depending on the function required for the oil as described above, the controllability of the oil pressure at the oil control valve 1 can be improved while the sliding performance and durability of the sliding bearing portions for supporting the camshaft 6 are improved.

(6) In the above-mentioned front cam cap 9A, as shown in FIG. 2, in the state in which the engine 10 is installed in the vehicle, the lateral passage 32 is inclined so as to become lower on the downstream side of the oil. In addition, the downward passage 33 is extended downward from the other end 32B of the lateral passage 32, that is, the lowest position of the lateral passage 32. With this flow passage configuration, the oil inside the lateral passage 32 can be moved to the downward passage 33 by using the natural dropping due to gravity, whereby the oil pressure inside the lateral passage 32 can be further reduced.

(7) In the above-mentioned cylinder head 2, the oil is supplied to the exhaust oil control valve 1B downward from the upper face side of the cylinder head 2 on which the front cam cap 9A is mounted. In other words, such an oil flow passage for making connection between the oil filter 11 and the exhaust oil control valve 1B is not required inside the cylinder head 2. For this reason, the structure of the cylinder head 2 can be simplified, and the cost for producing the product can be reduced. In addition, since the upward passage 31 for passing the oil into the front cam cap 9A may merely be formed in the vicinity of the intake oil control valve 1A in the direction extending upward from the third passage 23, the passage can be processed easily.

(8) The above-mentioned engine 10 has an advantage in that the engine can be produced on the basis of an existing engine in which the phase actuator 8 has been applied only to the intake camshaft 6A and by slightly changing the design of the engine. For example, in the case that the cylinder head 2 in which the first passage 21 and the second passage 22 are formed has already been available, the third passage 23 and the fourth passage 24 may merely be formed in the cylinder head. After the passages are formed, the structure of the above-mentioned engine 10 is embodied easily by forming the passages 31 to 33 inside the front cam cap 9A conforming to the cylinder head. As a result, labor for product development can be reduced, and the cost-performance ratio can be improved.

4. Modification

Regardless of the above-mentioned embodiment, there may be various modifications without departing from the gist thereof. The respective configurations of the embodiment can be selected as necessary or combined appropriately.

In the above-mentioned embodiment, although the oil passages relating to the driving of the phase actuator 8 and provided inside the front cam cap 9A are exemplified, the oil passages may also be provided inside the cam caps 9 other than the front cam cap 9A. For example, the second cam cap from the front side of the engine 10 (for example, the cam cap for supporting "the first journal" positioned right above the first cylinder) may be formed into a shape for fixing both the intake camshaft 6A and the exhaust camshaft 6B, and the oil passages may be formed inside the cam cap. Even in this case, effects similar to those of the above-mentioned embodiment are produced.

Furthermore, in the above-mentioned embodiment, although the passage for the oil to be supplied to the exhaust oil control valve 1B, being formed inside the front cam cap 9A, is exemplified, the destination of the force-fed oil is not limited to the passage. For example, as shown in FIG. 5(A), it is conceived that the first passage 21 is disposed on the exhaust side of the cylinder head 2 and the passage for the oil to be supplied to the intake oil control valve 1A is formed inside the front cam cap 9A.

With this oil passage structure, the oil can be supplied to the intake oil control valve 1A without providing a complicated oil-supplying route inside the cylinder head 2. In addition, the temperature of the oil to be introduced into the intake oil control valve 1A can be lowered, the controllability of the oil passage at the intake oil control valve 1A can be improved, and the operation stability, responsiveness and controllability of the phase actuator 8 can be improved.

Figure 5A:
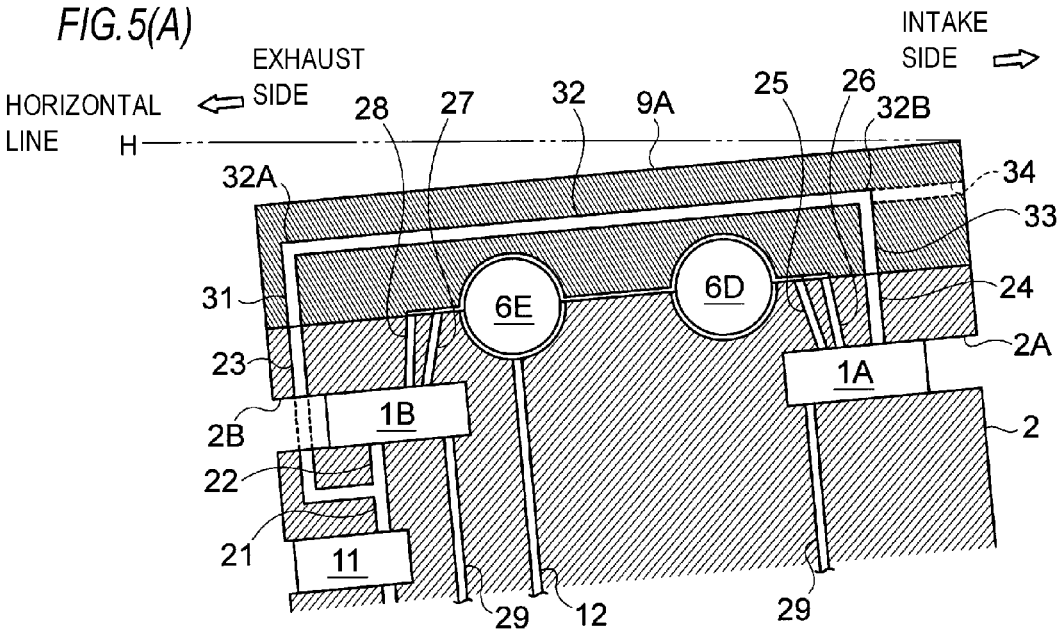
FIGS. 5(A) and 5(B) are schematic vertical cross-sectional views showing the internal structures of cam caps according to modifications.

FIG. 5(A) shows a case in which the engine 10 is installed in the vehicle in a state of being inclined toward the exhaust side. In this case, the gradient of the lateral passage 32 has a rising gradient. For the purpose of obtaining the flow action of the oil due to its weight, the inclination direction of the engine 10 may be reversed from the state shown in FIG. 5(A) to a horizontal state so that the gradient of the lateral passage 32 becomes downward.

Figure 5B:
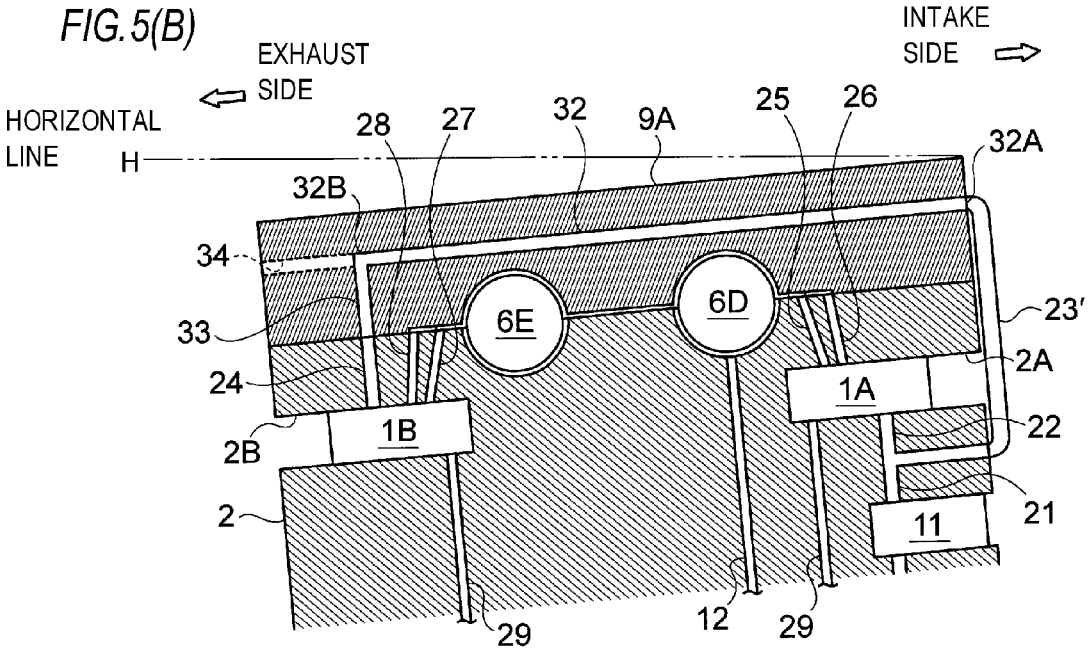

Furthermore, in the above-mentioned embodiment, although the three passages, that is, the upward passage 31, the lateral passage 32 and the downward passage 33, connected in an inverted U-shape so as to communicate mutually and disposed inside the front cam cap 9A are exemplified, the upward passage 31 is not an essential element. For example, as shown in FIG. 5(B), it is conceived to use a flow passage structure for introducing the oil from the end face on the intake side of the front cam cap 9A.

In this case, the third passage 23 branched from the first passage 21 may merely be connected to the piping material 23' extended to the outside of the cylinder head 2, the one end 32A of the lateral passage 32 may merely be passed through to one side face of the front cam cap 9A, and the tip end of the piping material 23' may merely be connected to the one end 32A. By the formation of at least the lateral passage 32 and the downward passage 33 inside the front cam cap 9A as described above, the effect of cooling oil and the effect of reducing oil pressure can be obtained, and effects similar to those of the above-mentioned embodiment are produced.

Moreover, in the above-mentioned embodiment, although the upward passage 31, the lateral passage 32 and the downward passage 33 being formed linearly are exemplified, the specific shapes of these passages can be set appropriately depending on processing capacity and processing accuracy. For example, the shape of these passages 31 to 33 may be a curved shape, and the diameter, width, cross-sectional area, cross-sectional shape, etc. thereof may be made different partially.

What's more, the above-mentioned cylinder head 2 may also be applied to engines (for example, inline three-cylinder engines and V six-cylinder engines) other than inline four-cylinder engines and may also be applied to engines (for example diesel engines) that use fuel other than gasoline.

According to an aspect of the invention, oil can be supplied to the oil control valve without providing a complicated oil-supplying route inside the cylinder head. In addition, the oil flow passages can be provided inside the cam cap positioned away from the fire contact face, the temperature of the oil to be introduced into the oil control valve can be lowered. As a result, the controllability of the oil passage of the oil control valve can be improved, and the operation stability, responsiveness and controllability of the variable valve mechanism, for example, can be improved.

What is claimed is:

1. An engine comprising:

an oil control valve which is built in a cylinder head, and which is configured to control a pressure of oil to be supplied to a variable valve mechanism via a camshaft; and a cam cap which is fixed to an upper face of the cylinder head, and which is configured to rotatably support the camshaft between the cam cap and the cylinder head, as a flow passage for the oil to be force-fed from an oil pump to the oil control valve, the cam cap including:

a lateral passage which is formed inside the cam cap, and which is extended in a direction along the upper face of the cylinder head; and a downward passage which is extended downward from the lateral passage so as to serve as a downstream side flow passage of the lateral passage, and which is configured to guide the oil toward the oil control valve.

2. The engine according to claim 1, wherein the cam cap includes a groove passage which is formed in a concave groove shape at a bottom face of the cam cap, and which is configured to guide the oil to be supplied via the oil control valve toward a supporting face for the camshaft.

3. The engine according to claim 2, wherein the variable valve mechanism is configured to control a phase angle of the camshaft, and the groove passage includes:

an advance angle groove passage serving as an oil flow passage for moving the phase angle in an advancing direction, and a delay angle groove passage serving as an oil flow passage for moving the phase angle in a delaying direction.

4. The engine according to claim 2, wherein a portion of the upper face of the cylinder head which is opposed to the groove passage of the cam cap is formed into a flat shape.

5. The engine according to claim 1, wherein the camshaft is an exhaust camshaft, the cam cap is configured to rotatably support the exhaust camshaft and an intake camshaft, and the oil control valve is an exhaust oil control valve to be used for a variable valve mechanism for an exhaust valve.

6. The engine according to claim 5, further comprising: an intake oil control valve which is disposed on an intake port side of the engine, and which is built in the cylinder head, the intake oil control valve which is configured to control a pressure of the oil to be supplied to a variable valve mechanism for an intake valve via the intake camshaft, wherein a flow passage for the oil to be force-fed from the oil pump to the intake oil control valve is formed in the cylinder head.

7. The engine according to claim 6, wherein the cam cap includes a groove passage for the variable valve mechanism for the intake valve, which is formed in a concave groove shape at a bottom face of the cam cap, and which is configured to guide the oil to be supplied via the intake oil control valve toward a supporting face for the intake camshaft.

8. The engine according to claim 5, wherein downward passage is disposed outside a range between the intake camshaft for driving an intake valve and the exhaust camshaft for driving the exhaust valve in an extension direction of the lateral passage.

9. The engine according to claim 5, wherein the cam cap includes a lubrication passage which is formed in a concave groove shape at a bottom face of the cam cap, and which is disposed so as to be connected between the intake camshaft for driving an intake valve and the exhaust camshaft for driving the exhaust valve.

10. The engine according to claim 1, wherein the lateral passage is inclined so as to become lower, as being extended toward a downstream side of the oil, and the downward passage is extended downward from a lowest end portion of the lateral passage.

11. The engine according to claim 1, wherein the downward passage is linearly connected between one end portion of the lateral passage and a bottom face of the cam cap.

12. The engine according to claim 11, wherein the oil is to be supplied from the other end portion of the lateral passage.

13. The engine according to claim 12, wherein, as the flow passage for the oil to be force-fed from the oil pump to the oil control valve, the cam cap includes an upward passage which is extended upward toward the other end portion of the lateral passage so as to serve as an upstream side flow passage of the lateral passage.

14. The engine according to claim 12, wherein the variable valve mechanism includes a variable valve mechanism for an intake valve and a variable valve mechanism for an exhaust valve, the variable mechanism for the intake valve is configured to control a phase angle of the intake camshaft and the variable mechanism for the exhaust valve is configured to control a phase angle of the exhaust camshaft, and for the variable valve mechanisms, the cam cap has groove passages that include:

an advance angle groove passage serving as an oil flow passage for moving the phase angle in an advancing direction, and a delay angle groove passage serving as an oil flow passage for moving the phase angle in a delaying direction.

15. The engine according to claim 1, wherein the lateral passage extends at least over an entire diameter of the camshaft from a first side of the camshaft with respect to a rotation axis of the camshaft to a second side of the camshaft, opposite to the first side, with respect to the rotation axis, and the downward passage is formed at the second side.

16. The engine according to claim 15, wherein the cam cap further includes an upward passage that extends in an upward direction and receives the oil from the pump, the upward passage is formed at the first side of the camshaft, and the lateral passage extends from an upper end of the upward passage.

17. An engine comprising:

an intake oil control valve which is built in a cylinder head, and which is configured to control a pressure of oil to be supplied to a variable valve mechanism for an intake valve via an intake camshaft;

an exhaust oil control valve which is built in the cylinder head, and which is configured to control a pressure of oil to be supplied to a variable valve mechanism for an exhaust valve via an exhaust camshaft;

a cam cap which is fixed to an upper face of the cylinder head, and which is configured to rotatably support the intake camshaft and the exhaust camshaft between the cam cap and the cylinder head;

an oil-supplying route for the intake oil control valve, through which the oil is force-fed from an oil pump built in the cylinder head to the intake oil control valve; and an oil-supplying route for the exhaust oil control valve, through which the oil is force-fed from the oil pump to the exhaust oil control valve via a passage formed inside the cam cap.

18. The engine according to claim 17, wherein the exhaust oil control valve is disposed at an exhaust side of the cylinder head with respect to the exhaust camshaft, and the passage extends at least over an entire distance between the intake camshaft and the exhaust camshaft.

19. The engine according to claim 18, wherein the intake oil control valve is disposed at an intake side of the cylinder head with respect to the intake camshaft, and the oil-supplying route for the exhaust oil control valve is branched from the oil-supplying route for the intake oil control valve and passes through the passage.

20. The engine according to claim 17, wherein the passage includes:

a lateral passage which is extended in a direction along the upper face of the cylinder head; and a downward passage which is extended downward from the lateral passage so as to serve as a downstream side flow passage of the lateral passage, and which is configured to guide the oil toward the exhaust oil control valve.

21. The engine according to claim 17, wherein the cam cap includes a groove passage which is formed in a concave groove shape at a bottom face of the cam cap, and which is configured to guide the oil to be supplied via the intake oil control valve and the exhaust oil control valve toward a supporting face for the intake camshaft and a supporting face for the exhaust camshaft.

22. The engine according to claim 21, wherein a portion of the upper face of the cylinder head which is opposed to the groove passage of the cam cap is formed into a flat shape.

* * * * *